US005518877A

United States Patent [19]

Helling et al.

[11] Patent Number: 5,518,877

[45] Date of Patent: May 21, 1996

[54] PHOTOGRAPHIC SILVER HALIDE MATERIAL

[75] Inventors: Günter Helling, Odenthal; Klaus Wagner, Bergisch Gladbach, both of Germany

[73] Assignee: Agfa-Gevaert AG, Germany

[21] Appl. No.: 380,019

[22] Filed: Jan. 27, 1995

[30] Foreign Application Priority Data

Feb. 7, 1994 [DE] Germany ..... 44 03 683.3

[51] Int. Cl.[6] ..... G03C 1/047; G03C 7/327; G03C 7/396

[52] U.S. Cl. ..... 430/628; 430/512; 430/517; 430/548; 430/566; 430/545; 430/627; 430/941; 430/642

[58] Field of Search ..... 430/627, 628, 430/630, 536, 642

[56] References Cited

U.S. PATENT DOCUMENTS

| | | | |
|---|---|---|---|
| 2,853,457 | 9/1958 | Gates, Jr. | 430/628 |
| 3,721,565 | 3/1973 | Fitzgerald | 430/627 |
| 3,881,923 | 5/1975 | Tanaka et al. | 430/58 |
| 3,923,517 | 12/1975 | Yamamoto et al. | 430/631 |
| 4,123,277 | 10/1978 | Ochiai | 430/536 |

FOREIGN PATENT DOCUMENTS

| | | |
|---|---|---|
| 534060 | 12/1954 | Belgium . |
| 0022784 | 2/1976 | Japan . |
| 55-069136 | 5/1980 | Japan . |

*Primary Examiner*—Richard L. Schilling
*Attorney, Agent, or Firm*—Connolly & Hutz

[57] ABSTRACT

Improved photographic properties are obtained if the photographic silver halide material contains a copolymer with polypeptide segments, wherein the polypeptide segments are derived from polypeptides with an average molecular weight $M_w$ of 2000 to 40000.

12 Claims, No Drawings

PHOTOGRAPHIC SILVER HALIDE MATERIAL

The present invention relates to a photographic silver halide material containing at least one polypeptide copolymer. The polypeptide copolymers may perform various functions in the photographic material depending upon the nature of the comonomer.

Gelatine derivatives obtained from degraded or hydrolysed gelatine by reaction with anhydrides of polybasic acids are known as covering power improvers. Gelatine derivatives still containing C—C double bonds are also used for this purpose if the reaction is performed with maleic anhydride or iraconic anhydride (DE-OS 2 129 758).

Gelatine derivatives obtained from inter alia enzymatically degraded gelatine by reaction with monofunctional compounds are known. These derivatives improve the reticulation produced on rapid processing (DE-OS 2 407 347).

It is also known to produce graft polymers with gelatine by reacting a hydrolysed gelatine with an acid anhydride or an aldehyde and then graft polymerising it with a monomer. Photographic materials containing these graft polymers exhibit reduced desensitisation at folds in the film material.

It is known from JP 51-022 784 to produce graft polymers on gelatine using water-soluble azo compounds and monomers. These graft polymers are, however, insoluble in water.

Gelatine/N-vinylpyrrolidone graft polymers are described in Zhi-Chong Li et al., *J. Photogr. Sci.* 40 (1992), pp. 248 et seq., which graft polymers are produced by polymerising N-vinylpyrrolidone in the presence of gelatine. A disadvantage of this process is that a substantial proportion of vinylpyrrolidone homopolymer is produced.

The object of the invention is to provide polymers which are produced by copolymerisation, which contain polypeptide units and are not contaminated or only slightly so by homopolymers.

SUMMARY OF THE INVENTION

The object is achieved by the polypeptides being reacted with reactive monomers to yield so-called peptide monomers, which are then reacted in a customary copolymerisation process with ethylenically unsaturated compounds to yield photographically useful polymers with polypeptide segments.

DETAILED DESCRIPTION OF THE INVENTION

These copolymers with polypeptide segments are used in the photographic material at a rate of 0.5 mg to 5 g/m$^2$, preferably 2.5 mg to 1 g/m$^2$.

The copolymers with polypeptide segments according to the invention, hereinafter copolymers, are useful inter alia as peptising agents for the production of photographic emulsions, as plasticisers, as polymeric couplers (if coupler monomers are copolymerised with the peptide monomers), as viscosity improvers.

The copolymers according to the invention are distinguished by distinctly improved colloid stability.

Polypeptides pursuant to this invention are amino acid condensation products linked by acid-amide type peptide bonds. The polypeptides have an average molecular weight $M_w$ of 2000 to 40000, preferably of 3000 to 30000.

Polypeptides may be synthesised by amino acid condensation using known peptide synthesis methods, as are for example described in E. Wünsch, *Synthese von Pepciden* [Synthesis of peptides] in Houben-Weyl, 4th edition, 1974, Georg Thieme Verlag. The polypeptides may, however, also be obtained by the degradation of higher molecular weight polypeptides, for example proteins, by hydrolyric or enzymatic degradation. The enzymes pepsin, trypsin, chymotrypsin, papain and collagenase are particularly suitable for enzymatic degradation. In another embodiment, degradation may also proceed by hydrolysis. To this end, the protein is heated in an aqueous solution with an acid at a pH of 0.1 to 1.0 or a base at a pH of 9.5 to 13.5 at temperatures of 50° to 70° C.

Molecular weights are determined using gel permeation chromatography. The molecular weight distribution is calculated using a calibration curve for polyethylene oxide or polystyrene sulphonic acid.

Suitable proteins from which the polypeptides are obtained by hydrolysis are gelatine, collagen, keratin, albumins, globulins. Collagen or gelatine is preferably used for hydrolyric degradation.

The polypeptides may also be synthesised using genetic engineering methods or by industrial microbiology.

The polypeptides required for the invention essentially comprise the amino acids glycine, alanine, serine, cysteine, phenylalanine, tyrosine, tryptophan, threonine, methionine, valine, proline, leucine, isoleucine, lysine, arginine, aspartic acid, asparagine, glutamic acid and glutamine. The polypeptides preferably contain glycine, proline, hydroxyproline, glutamic acid, alanine, arginine, aspartic acid and lysine.

The polypeptides which may be used according to the invention are more than 5 wt. % soluble in water at pH 7 and 20° C. and, as a 20 wt. % aqueous solution, have a viscosity of less than 20 mPa.s at 40° C.

Reactive monomers are in particular of the formula

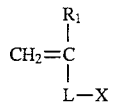

in which $R_1$ means H, optionally substituted alkyl, in particular with 1 to 4 C atoms, or halogen, in particular Cl, L means a chemical bond or a divalent bridging member and X means a reactive group.

A reactive group is taken to be a group which may react with the —$NH_2$—, —COOH— or —OH— groups of a polypeptide.

Preferred reactive groups X are

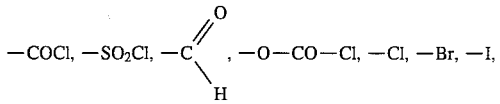

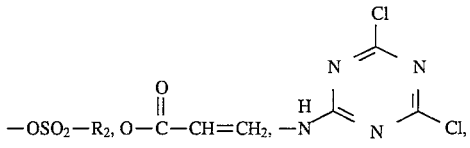

-continued

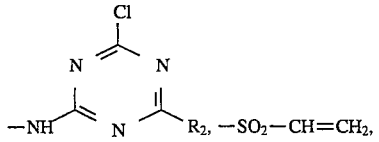

$-NH-$ $R_2$, $-SO_2-CH=CH_2$, $-COO-CH_2-CH(O)-CH_2$, $-CH_2-CH(O)-CH_2$, $-CH_2-CH(N-R_3)-CH_2$, $-NCO$, $-CONH-CH_2-OH$, $-CONH-CH_2-O-CH_3$, $-CO_2N$ 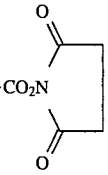 ,

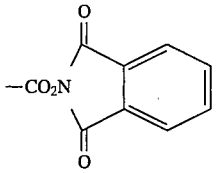 , 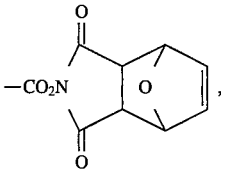 ,

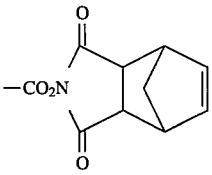 , 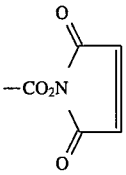 , 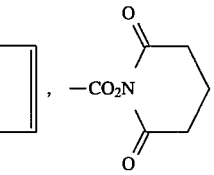 ,

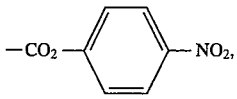 , 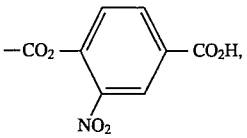

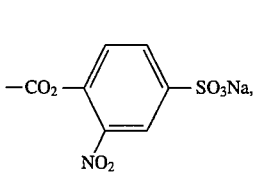 , 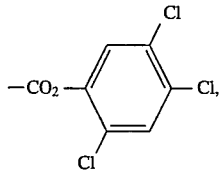

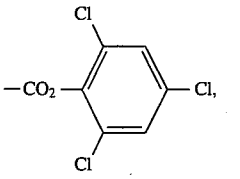 , 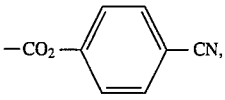

$-CO_2CH_2CN$, $-CO_2CH_2CO_2C_2H_5$, $-CO_2CH_2CONH_2$, $-CO_2-CH_2COCH_3$, $-CO_2CH_2CO-$ 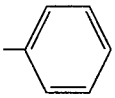 , $-CO_2CH_2CO_2CH=CH_2$, $-CO_2N=CHCH_3$, $-CO_2N=C(CH_3)_2$, $-CO_2C(CH_3)=CHCOOCH_3$, -continued $-CO_2CH_2N^{\oplus}$  $Cl^{\ominus}$, $-CO_2CH_2CH_2Br$, $-CO_2CH_2CH_2CN$, $-CO_2CH_2CH_2-N^{\oplus}(CH_3)_3$ $Cl^{\ominus}$ wherein $R_2$ means alkyl, aryl, aralkyl, preferably $C_1$–$C_4$ alkyl or phenyl and $R_3$ means hydrogen or alkyl, preferably hydrogen or $C_1$–$C_4$ alkyl.

Particularly preferred reactive groups are —COCl, —NCO, —Cl and —Br.

In a particularly preferred embodiment, the reactive monomer is of the following structure (II)

$$CH_2=C(R_1)-L_1-[L_2]_m-[L_3]_n-X \quad \text{(II)}$$

in which $R_1$ and X have the above-stated meaning, $L_1$ is a —CO—, —COO—, —CONH— or phenylene group, $L_2$ is an alkylene group with 1 to 20 C atoms or an arylene group with 6 to 20 C atoms, $L_3$ is a —COO—, —OCO—, —CONH—, —NH—CO—O—, —NHCO—, —$SO_2$NH—, —NH$SO_2$—, —$SO_2$— group or —O—, m is 0 or 1 n is also 0 in the event that m is 0, otherwise 0 or 1.

Particularly preferred examples of reactive monomers are stated below:

R1 $CH_2=C(CH_3)-COO-CH_2-CH_2-Cl$

R2 $CH_2=C(CH_3)-COO-CH_2-CH(O)-CH_2$

R3 $CH_2=C(CH_3)-COO-CH_2-CH_2-NCO$

R4 $CH_2=CH-CONH-CH_2-CH_2-NH-$ 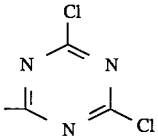

R5 $CH_2=CH-CO-Cl$

R6 $CH_2=C(CH_3)-COCl$

R7 $CH_2=C(CH_3)-CO-O-CH_2-CH(NH)-CH_2$

R8 $CH_2=C(CH_2-CO)(O)(CO)$

-continued

R9 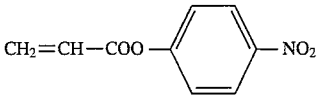

R10 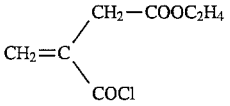

R11 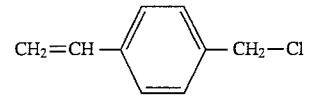

R12 $CH_2=CH-CONH-CH_2-CH_2-Br$

R13 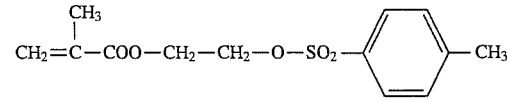

R14 $CH_2=C(CH_3)-COO-CH_2-CH_2-COO-CH_2-CN$

R15 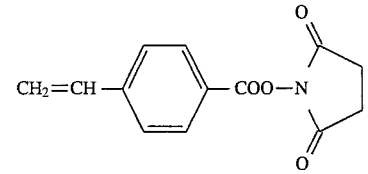

R16 $CH_2=CH-CONH-CH_2-SO_2-CH=CH_2$

R17 $CH_2=CH-CONH-CH_2-OH$

R18 $CH_2=CH-CONH-CH_2-O-CH_3$

R19 $CH_2=CH-COO-(CH_2)_6-COCl$

R20 $CH_2=CH(CH_3)-CONH-(CH_2)_{10}-COCl$

R21 $CH_2=C(CH_3)-COO-CH_2-CH_2-NH-CO-NH-(CH_2)_6-COCl$

R22 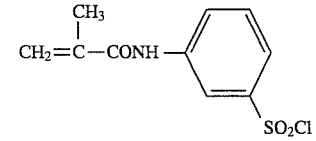

R23 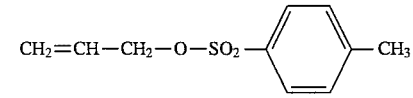

R24 $CH_2=CH-COO-CH_2-CH_2-COCl$

R25 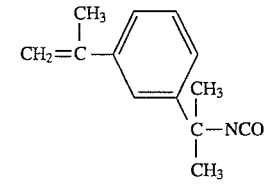

R26 $CH_2=CH-CH_2-COCl$

R27 $CH_2=CH-OOC-CH_2-Br$

R28 $CH_2=CH-O-CH_2-CH_2-Cl$

-continued

R29 $CH_2=CH-O-CH_2-CH(Br)-CH_2-Br$

R30 $CH_2=CH-NCO$

R31 $CH_2=C(CH_3)-COO-CH_2-CH=CH-CH_2-Cl$

R32 $CH_2=C(CH_3)-COO-CH_2-CH(OH)-CH_2-Cl$

R33 $CH_2=CH-COO-CH_2-CH(Br)-CH_2-Br$

R34 $CH_2=CH-CONH-CH_2-NH-CO-(CH_2)_2-SO_2-CH_2-CH_2-Cl$

R35 $CH_2=C(CH_3)-COO-(CH_2)_4-Br$

R36 $CH_2=C(CH_3)-COO-(CH_2)_2-O-CO-CH_2-Cl$

R37 $CH_2=C(CH_2-Br)(COOC_2H_5)$

R38 $CH_2=CO-NH-CH_2-CH_2-NH-CO-CH_2Cl$

R39 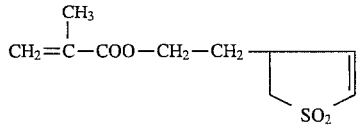

R-40 $CH_2=C(CH_3)-COO-CH_2-CH_2-NH-SO_2-CH=CH_2$

Peptide monomers

The peptide monomers according to the invention are produced by reacting the reactive monomers with the polypeptides in such a manner that the reactive group X of the reactive monomer reacts with the polypeptide and the ethylenically unsaturated group is retained. To this end, the reaction is preferably performed in the presence of polymerisation inhibitors. The peptide monomers are purified using known methods, for example by reprecipitation or dialysis.

The synthesis of the peptide monomers is illustrated by means of the following examples.

Polypeptide 1

600 g of lime pretreated gelatine are dissolved in 5.4 l of water and adjusted to pH 8.5 with a 10 wt. % sodium hydroxide solution. 300 g of a 2 wt. % trypsin solution is added to this solution and the mixture stirred at 40° C. until the pH has fallen to 6.7. After being left to stand for 24 hours at room temperature, the solution is concentrated and the polypeptide then precipitated by being stirred into acetone, filtered out and dried.

Yield: 96% of theoretical

Primary amino group content: 1.3%

Viscosity: 8 mPa.s (25 wt. % solution in $H_2O$, 40° C.)

$M_w$: 25000

Polypeptide 2

200 g of low-sulphur bone gelatine are swollen in 600 ml of 4 wt. % sodium hydroxide for 15 minutes and then stirred for 1 hour at 57° C. The mixture is then cooled, neutralised with hydrochloric acid and dialysed until no further chloride ions are detectable in the permeate.

Yield: 91% of theoretical

Viscosity: 7 mPa.s (20 wt. % solution in $H_2O$, 40° C.)

$M_w$: 3600

Polypeptide 3

300 g of a 10 wt. % acid pretreated gelatine is adjusted to pH 8.5 with 10 wt. % sodium hydroxide solution and combined at 40° C. with 15 g of a 2 wt. % trypsin solution and stirred for 80 minutes at 40° C. The polypeptide obtained is then precipitated with acetone, suction filtered, rewashed with acetone and dried.

Yield: 80% of theoretical

Viscosity: 8 mPa.s (20 wt. % solution in $H_2O$, 40° C.)

$M_w$: 23000

Polypeptide 4

200 g of low sulphur bone gelatine are swollen in 2 l of water, dissolved at 40° C. and combined with 18.2 g of concentrated hydrochloric acid. The mixture is then stirred for 1.5 hours at 80° C., cooled and adjusted to pH 7 with 10 wt. % sodium hydroxide solution. The mixture is then dialysed until the permeate is free of chloride.

Yield: 94% of theoretical

Viscosity: 8 mP.as (20 wt. % solution in $H_2O$, 40° C.)

$M_w$: 13000

Peptide monomer 1

25 g of polypeptide 3 are dissolved at 40° C. in 350 g of formamide. 4.0 g of R2 are then added dropwise within 5 minutes and the mixture stirred for 2 hours at 40° C. and pH 9. The reaction product is then precipitated by dropwise addition to 1 l of acetone, is suction filtered and rewashed with acetone and dried.

Yield: 60% of theoretical

Peptide monomer 2

50 g of polypeptide 2 are dissolved in 100 g of water, diluted with 50 ml of acetone and combined with 0.5 g of di-t.-butyl-p-cresol. A solution of 2 g of R6 in 20 g of acetone is added dropwise at room temperature within 20 minutes while the mixture is stirred. After a further 20 minutes' stirring, the solution is evaporated and the peptide monomer then precipitated with ethanol, suction filtered and rewashed with ethanol.

Yield: 63% of theoretical

Further peptide monomers were prepared in an analogous manner using other reactive monomers (see table 1).

TABLE 1

| Peptide monomer | Polypeptide | Quantity (g) | Reactive monomer | Quantity (g) | Yield |
|---|---|---|---|---|---|
| 3 | 1 | 28 g | R25 | 3.6 g | 84% |
| 4 | 3 | 24 g | R5 | 2.5 g | 86% |
| 5 | 1 | 24 g | R3 | 4.4 g | 78% |
| 6 | 1 | 24 g | R3 | 3.2 g | 80% |
| 7 | 3 | 24 g | R20 | 5.5 g | 83% |
| 8 | 2 | 24 g | R18 | 2.8 g | 79% |

Depending upon the application, various comonomers are suitable for production of the copolymers with the peptide monomers. The copolymers according to the invention may contain one or more comonomers. Examples of comonomers are: glyceryl methacrylate, N-(m-hydroxyphenyl-)methacrylamide, 2-hydroxyethyl acrylate, 2-phenyl-1-vinylimidazole, 2-hydroxypropyl acrylate, N-isopropylacrylamide, N-(1,1-dimethyl-3-dimethylamino-propyl)acrylamide, 2-methyl-1-vinylimidazole, 1-vinylimidazole, N-vinyl-ε-caprolactam, p-methanesulphonamidostyrene, N-methylmethacrylamide, methacrylamide, N-(3-oxo-n-butyl)maleimide, maleimide, N-(2-aminoethyl)methacrylamide hydrochloride, 2-hydroxyethyl methacrylate, methacryloylurea, N-(3-aminopropyl-)methacrylamide hydrochloride, N-(2-amino-2-methylpropyl)methacrylamide, methacrylic acid salt, acrylonitrile, α-chloroacrylonitrile, methacrylonitrile, N-(2-hydroxypropyl)methacrylamide, N-acryloylpiperidine, N-vinylsuccinimide, N-vinylphthalimide, 2-hydroxypropyl methacrylate, 2-(5-ethyl-2-pyridyl)ethyl acrylate, N-(3-methacryloyloxypropyl)thiourea, N-vinyl-2-pyrrolidone, p-aminostyrene, 2-(N,N-dibutylamino)ethyl acrylate, N-(4-vinylphenyl)thiourea, 3-acrylamido-2-oxotetrahydrothiophene, N-(4-methacryloyloxyphenyl)methanesulphonamide, 1,1-dicyano-4-[N-(t.-butyl)-N-(2-methacryloyloxyethylamino)-1,3-butadiene, N-(p-sulphamoylphenyl)maleimide, N-methacryloyl-p-toluenesulphonamide, N-(4-vinylphenyl)-N'-methylthiourea, 2-acrylamido-2-hydroxymethyl-1,3-propanediol, N,N-dimethylmethacrylamide, N-methylacrylamide, 2-ureidoethyl vinyl ether, N-methacryloyl-N'-ureidoacetylhydrazine, N-vinyl-N'-(2-hydroxyethyl)succinamide, 2-methyl-5-vinylpyridine, N-vinyl-N'-(2-amino-2-methylpropyl)succinamide, N-vinylcarbazole, 2-vinylpyridine, 4-vinylpyridine, N-isopropylmethacrylamide, N,N-dimethylacrylamide, 2-(2-chloro-4,6-dimethylphenyl)-5-acrylamidopyrazolin-3-one, 2-(diethylamino-)ethyl acrylate, 3,6-dimethyl-3,6-diazoheptyl acrylate, 2-(dimethylamino)ethyl acrylate, 2-(dimethylamino)ethyl methacrylate, 2-(diethylamino)ethyl methacrylate, 3-[3-(dimethylamino)propyl] acrylamide, acrylamide, N-(3-methyl-5-oxo-3-heptyl)acrylamide, N-(2-methyl-4-oxo-2-pentyl)acrylamide, N-methyl-2-aminoethyl methacrylate hydrochloride, allyl alcohol, N-acryloylmethionine methyl ester, N-methylolacrylamide, N-(3- or 5-hydroxymethyl-2-methyl-4-oxo-2pentyl)acrylamide, bis(1-dimethylaminoethyl)methyl methacrylate, N-(isobutoxymethyl)acrylamide, N-(isobutoxymethyl)methacrylamide, N-(m- and p-vinylbenzyl)-N,N-dimethylamine, m- and p-vinylbenzyl alcohol, 2-poly(ethyleneoxy) ethyl acrylate, ethylacrylamido acetate, methacryloyloxypolyglycerol, 2-(t.-butylamino)ethyl methacrylate, 3-[2-(dimethylamino)ethyl]acrylamide, 3-[2-(dimethylamino)ethyl]methacrylamide, 3-(diethylamino)propyl acrylate, 4-(diethylamino)-1-methylbutyl acrylate, 4-[N-(2-acryloyloxyethyl)-N-ethylamino]-1,1-dicyano-1,3-butadiene, 1,1-dicyano-4-[N-(1,1-dimethylethyl)-N-(2-methacryloyloxyethyl) amino]-1,3-butadiene, 1, 1-dicyano-4-([N-(1-dimethylethyl)-N-(2-methacryloyloxyethylcarbamoylethyl)amino]-1, 3-butadiene, N,N-diethyl-5-(m- and p-vinylphenyl)-3-ketopentanoylamide, t-pentyl acrylate, n-pentyl acrylate, 3-pentyl acrylate, n-butyl acrylate, benzyl acrylate, t-butyl methacrylate, 5-methyl-1, 3,6-heptatriene, 1,1-dihydroperfluorobutyl acrylate, di-n-butyl-α-methylene glutarate, benzyl methacrylate, 3-oxo-n-butyl acrylate, t-butyl acrylate, cyclohexyl acrylate, cyclopentyl acrylate, cetyl acrylate, cyclohexyl methacrylate, cyclopentadiene, butadiene, 2-norbornylmethyl acrylate, 2-(p-toluenesulphonyloxy) ethyl acrylate, trans-1,2-dichloroethylene, 2-norbornylmethyl methacrylate, diethylmethacryloyl malonate, dimethyl-α-methylene glutarate, ethyl methacrylate, ethylene, p-chlorostyrene, vinylthio(methylthio)methane, 1-vinylthio-4-methylthiobutane, isobutyl acrylate, ethyl-N-acryloylglycine, ethyl-5(m- and p-vinylphenyl)-3-ketopentanoate, methyl-5-(m- and p-vinylphenyl)-3-ketopentanoate, N-(3,6-dithiaheptyl)acrylamide, 2-ethylhexyl acrylate, bis(cyclohexylmethyl)-α-methylene glutarate, n-hexyl methacrylate, 3-ethyl-1-methylbutyl acrylate, N-(3,6-dithiaoctyl) acrylate, 2-ethylhexyl methacrylate, 2-isobornyl methacrylate, 6-(m- and p-vinylphenyl)-2, 4-hexanedione, diisobutyl-α-methylene glutarate, chloroprene, bis-(2-thiabutyl)methyl acrylate, n-butyl methacrylate, isobutyl methacrylate, 3-oxo-n-butyl methacrylate, isopropyl methacrylate, t-butyl-5-(m- and p-vinylphenyl)3-ketopentanoate, lauryl acrylate, lauryl methacrylate, methyl acrylate, methyl-α-chloroacrylate, methyl methacrylate, methyl vinyl ketone, 3-methyl-2-nitropropyl acrylate, 2-(3-nortricyclylmercapto)ethyl methacrylate, 1-vinylthio-3-methylthiopropane, 5-norbornen-2-yl-methyl methacrylate, N-(1,1-dimethyl-3-methylthiopropyl)acrylamide, 2-methyl-2-nitropropyl methacrylate, 5- (or 6-)methylmercapto-2-norbornylmethyl methacrylate, 3,7-dithio-1-octene, 3-methyl-2-norbornylmethyl methacrylate, 4-methyl-2-propylpentyl acrylate, n-octyl acrylate, n-octadecyl acrylate, n-octadecyl methacrylate, 2-ethoxyethyl acrylate, 2-ethoxyethyl methacrylate, n-octyl methacrylate, 2-methoxyethyl methacrylate, 2-methoxyethyl acrylate, 2-methoxymethoxyethyl acrylate, 1,3,6-octanene, ethyl acrylate, propyl acrylate, 2-cyanoethyl acrylate, dicyclopentenyl acrylate, 2,2,2-trifluoroethyl acrylate, phenyl acrylate, isopropyl acrylate, n-propyl methacrylate, N-(1,1-dimethyl-3-ethylthiopropyl)acrylamide, N-(3-thiabutyl) acrylamide, N-(3-thiaheptyl)acrylamide, 2,5-dichlorostyrene, N-[2-(4-t-butylphenylthio)ethyl]acrylamide, N-(2-phenyl-thioethyl)acrylamide, N-[2-(p-tolylthio) ethyl] acrylamide, n-hexyl acrylate, N-(1,1-dimethyl-2-methylthioethyl) acrylamide, 2-methacryloyloxyethyl tosylate, N-(3-thiabutyl)methacrylamide, styrene, N-[2,2-bis(ethylthio)ethyl]acrylamide, sec.-butyl acrylate, p-bromostyrene, o-chlorostyrene, p-fluorostyrene, m-chlorostyrene, p-t-butylstyrene, m- and p-(2thiapropyl)styrene, 2-(methylsulphinyl)ethyl acrylate, 2-(ethylsulphinyl)ethyl acrylate, trichloroethylene, 2,2-dimethylbutyl acrylate, neohexyl acrylate, 3-thiapentyl acrylate, N-(3-thiapentyl)-methacrylamide, 3-thiapentyl methacrylate, N-(3-thiapentyl)acrylamide, N-t-butylacrylamide, vinyl acetate, vinyl bromide, butyl vinyl ether, vinylidene bromide, vinyl chloride, vinyl ethyl thioacetate, vinyl isobutyrate, vinyl chloroacetate, vinyl-2-ethyl hexanoate, m- and p-vinyltoluene, 1-bromo-1-chloroethylene, vinyl neodecanoate, 3,4-dichlorostyrene, dimethyl-2-methyl-1,3-butadienyl phosphate, dimethyl-1-propen-2-yl phosphate, α-methylstyrene, methacryloyloxyethyl trifluoroacetate, N-phenylmaleimide, N-(p-chlorophenyl)maleimide, methyl vinyl ether, 2-(methoxymethoxy)ethyl acrylate, methyl-p-styrene sulphonate, ethyl o- and p-styrene sulphonate, vinyl benzyl acetate, vinyl benzoate, 4-acryloyloxybutane-1-sulphonic acid Na salt, 3-acryloyloxy-1-methylpropane-1-sulphonic acid Na salt, acrylic acid, citraconic acid, chlorofumaric acid, monomethyl-α-methylene glutarate, 3-allyloxy-2-hydroxypropanesulphonic acid Na salt, α-chloroacrylic acid, β-acryloyloxypropionic acid, β-acryloyloxyethyl monophosphate, potassium 3-acryloyl-oxypropyl phosphate, potassium 2-acryloyloxyethyl phosphate, mono-(3-acryloyloxypropyl) phosphate, 4-t-butyl-9-methyl-8-oxo-7-oxo-4-aza-9-decen-1-sulphonic acid, methacrylic acid, mono-(2-methacryloyloxyethyl) phosphate, potassium 3-methacryloyloxypropyl phosphate, mono-(3-methacryloyloxypropyl) phosphate, vinylsulphonic acid Na salt, fumaric acid, monoethyl fumarate, monomethyl fumarate, 3-acrylamido-3-methylbutyric acid, monomethyl itaconate, bis-(3-sodiumsulphopropyl) itaconate, iraconic acid, maleic acid, mesaconic acid, α-methyleneglutaric acid, N-(2-amino-2-methylpropyl)maleic acid, 2-acryloyloxyethylsulphuric acid Na salt, 2-methacryloyloxyethylsulphuric acid, N-[4-(2-amino-2-methylpropyl)-1-methylcyclohexyl] maleic acid, pyridinium-2-methacryloyloxyethyl sulphate, crotonic acid, 3-acrylaminodpropane-1-sulphonic acid K salt, ammonium-(8-methacryloyloxy-3, 6-dioxaoctyl) sulphate, p-styrenesulphonic acid Na salt, vinylphenylmethanesulphonic acid Na salt, 3-methacryloyloxypropane-1-sulphonic acid Na salt, 3-methacryloyloxypropane-1-methylsulphonic acid Na salt, 4-methacryloyloxybutane-1-sulphonic acid Na salt, 2-methacryloyloxyethyl-1-sulphonic acid Na salt, 2-acrylamido-2-methylpropanesulphonic acid Na salt, 3-methacryloyloxypropane-1-sulphonic acid K salt, 3-acryloyloxypropane-1-sulphonic acid Na salt, methacrylic acid Na salt, lithium methacrylate, N-[2-(N-methylsulphonyl-N-potassiosulphamoyl) ethyl]methacrylamide, N-[2-(N-phenylsulphonylsulphamoyl) ethyl]acrylamide, N-[2-N-phenylsulphonylsulphamoyl)ethyl] methacrylamide, N-(m- and p-vinylbenzyl)iminodiacetic acid, monodecyl itaconate, monododecyl itaconate, monotetradecyl itaconate, monohexadecyl itaconate, monohexyl itaconate, monooctyl itaconate, 2-methacryloyloxyethyl-1-sulphonic acid, ammonium p-styrene sulphonate, sodium o- and p-styrene sulphonate, potassium o- and p-styrene sulphonate, monovinyl adipate, 2-acrylamido-2-methylpropanesulphonic acid Na salt, N-(3-acrylamidopropyl)ammonium methacrylate, N-(2-methacryloyloxyethyl)-N,N,N-trimethylammonium iodide, N-(2-methacryloyloxyethyl)-N,N,N-trimethylammonium p-toluenesulphonate, 2-methacryloyloxyethylthiuroniummethane sulphonate, 3-methacryloyloxypropylthiuronium tosylate, 1,2-dimethyl-5-vinylpyridinium methosulphate, N-(2-methacryloyloxyethyl)-N,N,N-trimethylammonium bromide, N-(2-hydroxy-3-methacryloyloxypropyl)-N,N,N-trimethylammonium sulphate, N-(2-hydroxy-3-methacryloyloxypropyl)-N,N,N-trimethylammonium chloride, N-vinylbenzyl-N,N,N-trimethylammonium chloride, N-(3-acrylamido-3,3-dimethylpropyl)-N, N,N-trimethylammonium methosulphate, 3-methyl-1-vinylimidazolium methosulphate, N-(3-methacryl-amidopropyl)-N-benzyl-N, N-dimethylammonium chloride, N-(3-methacrylamidopropyl)-N, N,N-trimethylammonium chloride, N-(2-acryloyloxyethyl)-N,N,N-trimethylammonium methosulphate, N-(2-methacryloyloxyethyl)-N,N-dimethyl-N-benzylammonium chloride, 3-(2-methyl-5-vinylpyridino)propyl sulphonate, N,N'-methylenebisacrylamide, ethylene dimethacrylate, 2,2-dimethyl-1,3-propylene diacrylate, divinylbenzene, mono-

[2,3-bis(methacryloyloxy)propyl] phosphate, N,N'-bis-(methacryloyl)urea, triallyl cyanurate, allyl acrylate, allylmethacrylate, N-alkylmethacrylamide, 4,4'-isopropylidenediphenylene diacrylate, 1,3-butenylene diacrylate, 1,4-cyclohexylenedimethylene dimethacrylate, 2,2'-oxydiethylene dimethacrylate, divinyloxymethane, ethylene diacrylate, ethylidene diacrylate, propylidene dimethacrylate, 1,6-diacrylamidohexane, 1,6-hexamethylene diacrylate, 1,6-hexamethylene dimethacrylate, phenylethylene dimethacrylate, tetramethylene dimethacrylate, 2,2,2-trichloroethylidene dimethacrylate, ethylenebis(oxyethylene) diacrylate, ethylenebis(oxyethylene) dimethacrylate, ethylidyne trimethacrylate, propylidyne triacrylate, vinylallyloxy acetate, 1-vinyloxy-2-allyloxyethane, 2-crotonyloxyethyl methacrylate, diallyl phthalate, 2-(5-phenyl-2,4-pentadienoyloxy)ethyl methacrylate, N-allylcyanoacrylamide, ethylmethacryloyl acetoacetate, acryloylacetone, methacryloylacetone, ethylacryloyl acetate, N-(2-acetoacetoxyethyl)acrylamide, 3-methyacryloyl-2,4-pentanedione, N-(methacryloyloxyethyl)acetoacetamide, 2-acetoacetoxyethyl methacrylate, N-t-butyl-N-(2-methacryloylethyl)acetoacetamide, 2- and 3-acetoacetoxypropyl acrylate, 2-acetoacetoxyethyl acrylate, 2-acetoacetoxy-2-methylpropyl methacrylate, ethylmethacryloyl acetate, N-(3-acetoacetamidopropyl)methacrylamide, N,N-dimethylacryloylacetamide, N-(3methacryloyloxypropyl)cyanoacetamide, 2-aminoethyl methacrylate, 2-hydroxypropyl methacrylate, 2-methacryloyloxyethyl mesylate, p-aminostyrene, m- and p-(2-chloroethylsulphonylmethyl-)styrene, methacrylic acid, acrylic acid, methacrylamide, 3-(N,N-diethylamino)propyl acrylate, vinyl chloroacetate, vinylbenzaldehyde, 2-cinnamoyloxyethyl methacrylate, triallyl isocyanurate, N-(3- and 4-vinylphenyl)-N'-(3-chloropropionyl)urea, N-(3- and 4-vinylphenyl)-3-chloropropionamide, 2-(N-methyl-2-methacryloyloxyethylamino)-4,6-dichloro-s-triazine, N-(2-methacryloyloxyethyl)-N'-(3-chloropropionyl)urea, N-(3-methacrylamidopropyl)-N'-(3-chloropropionyl)urea, N-(3-methacrylamidopropyl)-N'-(2-chloroacetyl)urea, N-[3-(3-chloropropionamido)propyl] methacrylamide, m-methacrylamidophenol, m-acrylamidophenol.

Preferred comonomers are of the formula (III)

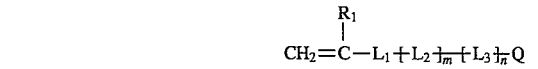

in which $R_1$, $L_1$, $L_2$, $L_3$, m and n have the above-stated meaning and

Q is a group which is non-reactive with —$NH_2$, —COOH, or —OH, in particular optionally non-reactively substituted alkyl, aryl or aralkyl or a photographically useful group.

Suitable photographically useful groups are chemical structural units which perform the function of a UV absorber, a filter dye, a mordant, a development inhibitor, a developer, a bleach, a bleach inhibitor, a cyan, magenta or yellow coupler, a white coupler, a wetting agent, a DIR or DAR coupler, a masking coupler. Comonomers with these structures are described in U.S. Pat. No. 5,234,807.

The copolymers prepared from peptide monomers and comonomers according to the invention contain at least 3 wt. %, preferably at least 10 wt. % peptide monomer. Synthesis of the copolymers is described below.

In particular, the copolymers according to the invention consist of 1 to 60 wt. % of residues derived from the peptide monomers and 40 to 99 wt. % of residues derived from the comonomers.

Copolymer 1

40 g of peptide monomer 2 is dissolved in 2 l of water and combined with 40 g of N-vinylpyrrolidone. The solution is heated under a nitrogen atmosphere to 90° C. while being stirred and then a solution of 0.8 g of azobiscyanovaleric acid dissolved in 80 ml of water is added. After 4 hours' stirring at 90° C., the viscous solution is evaporated in a rotary evaporator and the copolymer then precipitated with acetone, vacuum filtered and dried.

Yield: 84% of theoretical

Copolymer 2

625 g of water and 1.25 g of dodecylbenzenesulphonate are heated to 80° C. under an inert gas atmosphere. To this is added dropwise within 1 hour a solution of 15 g of peptide monomer 3 in 120 g of water and 238 g of ethyl acrylate and 375 g of a 1 wt. % solution of azobiscyanovaleric acid. After a further 2 hours' stirring a finely divided stable latex is obtained.

Yield: 95%

Average particle size: 64 nm

Further copolymers are produced using the method described for copolymer 1 (method 1) or copolymer 2 (method 2) (see table 2 ).

The copolymers according to the invention may be used in all layers of a photographic material; they are preferably added to the photosensitive silver halide emulsion layers, wherein use in colour photographic materials is preferred.

In a particularly preferred embodiment, the copolymers according to the invention are added to one or more of the precipitation solutions before or during silver halide precipitation.

TABLE 2

| Copolymer | Method | Peptide monomer/g | | Comonomer/g | Yield |
|---|---|---|---|---|---|
| 3 | 1 | 2 | 40 g | vinyl imidazole 40 g | 35% |
| 4 | 1 | 4 | 40 g | acryloylmorpholine 80 g | 92% |
| 5 | 1 | 5 | 40 g | vinylpyrrolidone 40 g | 87% |
| 6 | 1 | 5 | 40 g | vinylpyridine 30 g | 89% |
| 7 | 1 | 2 | 40 g | i-propylacrylamide 40 g | 91% |
| 8 | 1 | 2 | 40 g | diacetone acrylamide 40 g | 95% |
| 9 | 1 | 7 | 40 g | 3-thiapentyl acrylate 10 g | 83% |
| 10 | 1 | 6 | 40 g | methacryloylurea 40 g | 90% |
| 11 | 1 | 3 | 40 g | 2-methyl-1-vinyl-imidazole 40 g | 91% |
| 12 | 1 | 3 | 40 g | N-(isobutoxymethyl) acrylamide 40 g | 87% |
| 13 | 1 | 2 | 40 g | vinylpyrrolidone 20 g | 90% |
| 14 | 1 | 2 | 40 g | N,N-dimethyl-methacrylamide 10 g | 94% |
| 15 | 2 | 2 | 15 g | butyl acrylate 235 g | 93% |
| 16 | 2 | 3 | 25 g | ethyl acrylate 225 g | 95% |
| 17 | 2 | 5 | 50 g | methyl meth-acrylate 200 g | 90% |
| 18 | 2 | 4 | 15 g | ethyl acrylate 225 g acrylamido-2-methylpropane-sulphonic acid 10 g | 87% |
| 19 | 1 | 4 | 40 g | sulphoethyl meth-acrylate 80 g | 96% |
| 20 | 2 | 2 | 25 g | core butyl | 93% |

TABLE 2-continued

| Copolymer | Method | Peptide monomer/g | Comonomer/g | Yield |
|---|---|---|---|---|
| 21 | 2 | 3 15 g | acrylate/[1] 225 g shell styrene core butyl acrylate/[1] 235 g shell methyl methacrylate | 92% |

[1]core/shell = 90/10 parts by weight.

In relation to the gelatine content of the photographic material, the copolymer according to the invention comprises 0.01–50 wt. %, preferably 0.05–10 wt. %.

The gelatine to silver ratio by weight in the photographic material is preferably 0.3–1.5.

The photographic silver halide material may comprise black-&-white or, preferably, colour photographic materials.

Examples of colour photographic materials are colour negative films, colour reversal films, colour positive films, colour photographic paper, colour reversal photographic paper, colour sensitive materials for the dye diffusion transfer process or the silver dye bleaching process.

Suitable supports for the production of colour photographic materials are, for example, films and sheets of semi-synthetic and synthetic polymers, such as cellulose nitrate, cellulose acetate, cellulose butyrate, polystyrene, polyvinyl chloride, polyethylene terephthalate and polycarbonate and paper laminated with a barytes layer or an α-olefin polymer layer (for example polyethylene). These supports may be coloured with dyes and pigments, for example titanium dioxide. They may also be coloured black in order to provide light shielding. The surface of the support is generally subjected to a treatment in order to improve the adhesion of the photographic emulsion layer, for example to a corona discharge with subsequent application of a substrate layer.

The colour photographic materials customarily contain at least one red-sensitive, one green-sensitive and one blue-sensitive silver halide emulsion layer, optionally together with interlayers and protective layers.

The substantial constituents of the colour photographic emulsion layers are binder, silver halide grains and colour couplers.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinylpyrrolidone, polyacrylamides, polyacrylic acid and the derivatives thereof, in particular the copolymers thereof. Naturally occurring gelatine substitutes are, for example, other proteins such as albumin or casein, cellulose, sugar, starch or alginates. Semi-synthetic gelatine substitutes are usually modified natural products. Cellulose derivatives such as hydroxyalkylcellulose, carboxymethylcellulose and phthalylcellulose together with gelatine derivatives obtained by reaction with alkylating or acylating agents or by grafting polymerisable monomers, are examples of such products.

The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. Gelatines with high viscosity and low swelling are particularly advantageous.

The silver halide present in the photographic material as the photosensitive constituent may contain chloride, bromide or iodide or mixtures thereof as the halide. For example, the halide content of at least one layer may consist of 0 to 15 mol % iodide, 0 to 100 mol % chloride and 0 to 100 mol % bromide. In the case of colour negative and colour reversal films, silver bromide-iodide emulsions are customarily used, in the case of colour negative and colour reversal paper, silver chloride-bromide emulsions with a high chloride content up to pure silver chloride emulsions are customarily used. The crystals may be predominantly compact, for example regularly cubic or octahedral, or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains deviate by no more than ±30% from the average grain size. The emulsions may, in addition to the silver halide, also contain organic silver salts, for example silver benzotriazolate or silver behenate.

Two or more types of silver halide emulsions which are produced separately may be used as a mixture.

Salts or complexes of metals such as Cd, Zn, Pb, Tl, Bi, Ir, Rh, Fe may also be present during precipitation and/or physical ripening of the silver halide grains.

Precipitation may furthermore also proceed in the presence of sensitising dyes. Complexing agents and/or dyes may be made ineffective at any desired point in time, for example by altering the pH value or by oxidative treatment.

On completion of crystal formation, or also at an earlier point in time, the soluble salts are eliminated from the emulsion, for example by noodling and washing, by flocculation and washing, by ultrafiltration or by ion exchangers.

The silver halide emulsion is generally subjected to chemical sensitisation under defined conditions—pH, pAg, temperature, gelatine concentration, silver halide concentration and sensitiser concentration—until optimum sensitivity and fog are achieved. The procedure is described in, for example, H. Frieser, *Die Grundlagen der Photographischen Prozesse mit Silberhalogeniden* [The principles of photographic processes with silver halides], pages 675–734, Akademische Verlagsgesellschaft (1968).

At this stage, chemical sensitisation may proceed with the addition of compounds of sulphur, selenium, tellurium and/or compounds of metals of subgroup VIII of the periodic table (for example gold, platinum, palladium, iridium), furthermore there may be added thiocyanate compounds, surface-active compounds, such as thioethers, heterocyclic nitrogen compounds (for example imidazoles, azaindenes) or also spectral sensitisers (described, for example, in F. Hamer, *The Cyanine Dyes and Related Compounds,* 1964, or *Ullmanns Encyclopädie der technischen Chemie* [Ullmann's encyclopaedia of industrial chemistry], 4th edition, volume 18, pages 431 et seq., and Research Disclosure 17643 (December, 1978), section III). Alternatively or additionally, reduction sensitisation may be performed by adding reducing agents (tin(II) salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilise the photographic function during production, storage or photographic processing.

Particularly suitable are azaindenes, preferably tetra- and pentaazaindenes, particularly those substituted with hydroxyl or amino groups. Such compounds have been described, for example, by Birr, *Z. Wiss. Phot.*, 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercaptopyrimidines, wherein these mercaptoazoles may also contain a water solubilising group, for example a carboxyl group or sulpho group. Further suitable compounds are published in *Research Disclosure* 17643 (December 1978), section VI.

The stabilisers may be added to the silver halide emulsions before, during or after ripening of the emulsions. Naturally, the compounds may also be added to other photographic layers which are associated with a silver halide layer.

Mixtures of two or more of the stated compounds may also be used.

The photographic emulsion layers or other hydrophilic colloidal layers of the photosensitive material produced according to the invention may contain surface-active agents for various purposes, such as coating auxiliaries, to prevent formation of electric charges, to improve sliding properties, to emulsify the dispersion, to prevent adhesion and to improve photographic characteristics (for example acceleration of development, high contrast, sensitisation etc.). Apart from natural surface-active compounds, for example saponin, it is mainly synthetic surface-active compounds (surfactants) which are used: non-ionic surfactants, for example alkylene oxide compounds, glycerol compounds or glycidol compounds, cationic surfactants, for example higher alkylamines, quaternary ammonium salts, pyridine compounds and other heterocyclic compounds, sulphonium compounds or phosphonium compounds, anionic surfactants containing an acid group, for example a carboxylic acid, sulphonic acid, phosphoric acid, sulphuric acid ester or phosphoric acid ester group, ampholytic surfactants, for example amino acid and aminosulphonic acid compounds together with sulphuric or phosphoric acid esters of an amino alcohol.

The photographic emulsions may be spectrally sensitised by using methine dyes or other dyes. Particularly suitable dyes are cyanine dyes, merocyanine dyes and complex merocyanine dyes.

A review of the polymethine dyes suitable as spectral sensitisers, suitable combinations of the dyes and the combinations with supersensitising effects is contained in *Research Disclosure* 17643, 1978, section IV.

In particular, the following dyes—classified by spectral range—are suitable:

1. as red sensitisers 9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines, provided that the dyes bear at least one sulphoalkyl group on the heterocyclic nitrogen.
2. as green sensitisers 9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.
3. as blue sensitisers symmetrical or asymmetrical benzimidiazo-, oxa-, thia- or selenocyanines with at least one sulphoalkyl group on the heterocyclic nitrogen and optionally further substituents on the aromatic ring, together with apomerocyanines with a rhodanine group.

Sensitisers may be dispensed with if, for a specific spectral range, the intrinsic sensitivity of the silver halide is sufficient, for example the blue sensitivity of silver bromides.

The differently sensitised emulsion layers are associated with non-diffusing monomeric or polymeric colour couplers which may be located in the same layer or in an adjacent layer. Usually, cyan couplers are associated with the red-sensitive layers, magenta couplers with the green-sensitive layers and yellow couplers with the blue-sensitive layers.

Colour couplers to produce the cyan partial colour image are generally couplers of the phenol or α-naphthol type.

Colour couplers to produce the magenta partial colour image are generally couplers of the 5-pyrazolone, indazolone or pyrazoloazole type.

Colour couplers to produce the yellow partial colour image are generally couplers with an open-chain ketomethylene grouping, in particular couplers of the α-acylacetamide type; suitable examples of these are α-benzoylacetanilide couplers and α-pivaloylacetanilide couplers.

The colour couplers may be 4-equivalent couplers, but they may also be 2-equivalent couplers. The latter are differentiated from 4-equivalent couplers by containing a substituent at the coupling site which is eliminated on coupling. 2-equivalent couplers are considered to be those which are colourless, as well as those which have an intense intrinsic colour which on colour coupling disappears or is replaced by the colour of the image dye produced (masking couplers), and white couplers which, on reaction with colour developer oxidation products, give rise to substantially colourless products. 2-equivalent couplers are further considered to be those which contain an eliminable residue at the coupling site, which residue is liberated on reaction with colour developer oxidation products and so either directly or after one or more further groups are eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator. Examples of such 2-equivalent couplers are the known DIR couplers as well as DAR or FAR couplers.

The material may, in addition to couplers, contain various compounds which, for example, may liberate a development inhibitor, a development accelerator, a bleach accelerator, a developer, a silver halide solvent, a fogging agent or an anti-fogging agent, for example so-called DIR hydroquinones and other compounds as, for example, described in U.S. Pat. No. 4,636,546, 4,345,024, 4,684,604 and in DE-A-31 45 640, 25 15 213, 24 47 079 and in EP-A-198 438. These compounds fulfil the same function as the DIR, DAR or FAR couplers, except that they form no coupling products.

High-molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high-molecular weight colour couplers are generally produced by polymerisation of ethylenically unsaturated monomeric colour couplers. They may, however, also be obtained by polyaddition or polycondensation.

Particularly suitable high-molecular weight couplers are compounds according to the invention in which Q is a colour coupler residue.

The incorporation of couplers or other compounds into the silver halide emulsion layers may proceed by initially producing a solution, dispersion or emulsion of the compound concerned and then adding it to the pouring solution for the layer concerned. Selection of the appropriate solvent or dispersant depends on the particular solubility of the compound.

Methods for the introduction of compounds which are substantially insoluble in water by a grinding process are described, for example, in DE-A-26 09 741 and DE-A-26 09 742.

Hydrophobic compounds may also be introduced into the pouring solution by using high-boiling solvents, so-called oil formers. Corresponding methods are described, for example, in U.S. Pat. No. 2,322,027, U.S. Pat. No. 2,801,170, U.S. Pat. No. 2,801,171 and EP-A-0 043 037.

Oligomers or polymers, so-called polymeric oil formers, may be used instead of high-boiling solvents.

The compounds may also be introduced into the pouring solution in the form of filled latices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4,291,113.

The non-diffusible inclusion of anionic water-soluble compounds (for example of dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Each of the differently sensitised photosensitive layers may consist of a single layer or may also comprise two or more partial layers of silver halide emulsion (DE-C-1 121 470). Here, red-sensitive silver halide emulsion layers are often closer to the film support than green-sensitive silver halide emulsion layers and these in turn are closer than blue-sensitive layers, wherein there is generally a non-photosensitive yellow filter layer between the green-sensitive layers and the blue-sensitive layers.

In cases of suitably low intrinsic sensitivity of the green or red-sensitive layers, different layer arrangements may be selected, dispensing with the yellow filter layer, in which, for example, the blue-sensitive, then the red-sensitive and finally the green-sensitive layers follow each other on the support.

The non-photosensitive interlayers generally located between layers of different spectral sensitivity may contain agents which prevent an undesirable diffusion of developer oxidation products from one photosensitive layer into another photosensitive layer with a different spectral sensitisation.

If there are several partial layers of the same spectral sensitisation, then they may differ in composition, particularly in terms of the type and quantity of silver halide grains. In general, the partial layer with the greater sensitivity will be located further from the support than the partial layer with lower sensitivity. Partial layers of the same spectral sensitisation may be adjacent to each other or may be separated by other layers, for example layers of different spectral sensitisation. Thus, for example, all high sensitivity and all low sensitivity layers may be grouped together each in a package of layers (DE-A-19 58 709, DE-A-25 30 645, DE-A-26 22 922).

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

The layers of the photographic material according to the invention may be hardened with customary hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A-974,723 and GB-A-1,167,207), divinylsulphone compounds, 5-acetyl-1, 3-diacryloylhexahydro-1, 3,5-triazine and other compounds containing a reactive olefin bond (U.S. Pat. No. 3,635,718, U.S. Pat. No. 3,232,763 and GB-A-994,869); N-hydroxymethylphthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,01 7,280 and U.S. Pat. No. 2,983,611); acid derivatives (U.S. Pat. No. 2,725,294 and U.S. Pat. No. 2,725,295); compounds of the carbodiimide type (U.S. Pat. No. 3,100,704); carbamoylpyridinium salts (DE-A-22 25 230 and DE-A-24 39 551); carbamoyloxypyridinium compounds (DE-A-24 08 814) ; compounds with a phosphorus-halogen bond (JP-A-113 929/83 ); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds with two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halogen carboxyaldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the pouring solution for the layer to hardened, or by overcoating the layer to be hardened with a layer containing a diffusible hardener.

There are included in the classes listed slow acting and fast acting hardeners as well as so-called instant hardeners, which are particularly advantageous. Instant hardeners are taken to be compounds which harden suitable binders in such a way that immediately after pouring, at the latest after 24 hours, preferably at the latest after 8 hours, hardening is concluded Go such an extent that there is no further alteration in the sensitometry and swelling of the layered structure determined by the crosslinking reaction. Swelling is taken to be the difference between the wet layer thickness and the dry layer thickness during aqueous processing of the film (*Photogr. Sci. Eng.* 8 (1964), 275; Photogr. Sci. Eng. (1972), 449).

These hardeners which react very rapidly with gelatine are, for example, carbamoylpyridinium salts, which are capable of reacting with the free carboxyl groups of the gelatine, so that the latter react with free amino groups of the gelatine to form peptide bonds crosslinking the gelatine.

Colour photographic negative materials are customarily processed by developing, bleaching, fixing and rinsing or by developing, bleaching, fixing and stabilising without subsequent rinsing, wherein bleaching and fixing may be combined into a single processing stage. Colour developer compounds which may be used are all developer compounds having the ability to react, in the form of their oxidation product, with colour couplers to form azomethine or indophenol dyes. Suitable colour developer compounds are aromatic compounds containing at least one primary amino group of the p-phenylenediamine type, for example N,N-dialkyl-p-pheneylenediamines such as N,N-diethyl-p-phenylenediamine, 1-(N-ethyl-N-methane-sulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Further usable colour developers are, for example, described in *J. Amer. Chem. Soc.* 73, 3106 (1951) and G. Haist *Modern Photographic Processing,* 1979, John Wiley & Sons, New York, pages 545 et seq.

An acid stop bath or rinsing may follow after colour development.

Customarily, the material is bleached and fixed immediately after colour development. Bleaches which may be used are, for example, Fe(III) salts and Fe(III) complex salts such as ferricyanides, dichromates, water soluble cobalt complexes. Iron(III) complexes of aminopolycarboxylic acids are particularly preferred, in particular for example complexes of ethylenediaminetetraacetic acid, propylenediaminetetraacetic acid, diethylenetriaminepentaacetic acid, nitrilotriacetic acid, iminodiacetic acid, N-hydroxyethylethylenediaminetriacetic acid, alkyliminodicarboxylic acids and of corresponding phosphonic acids. Persulphates and peroxides, for example hydrogen peroxide, are also suitable as bleaches.

Rinsing usually follows the bleaching-fixing bath or fixing bath, which is performed as countercurrent rinsing or comprises several tanks with their own water supply.

Favourable results may be obtained by using a subsequent finishing bath which contains no or only a little formaldehyde.

Rinsing may, however, be completely replaced with a stabilising bath, which is customarily performed countercurrently. If formaldehyde is added, this stabilising bath also performs the function of a finishing bath.

Colour reversal materials are first developed with a black-&-white developer, the oxidation product of which is not capable of reacting with the colour couplers. A second diffuse exposure is then performed, followed by development with a colour developer, bleaching and fixing.

EXAMPLE 1

Emulsion 1 (EM 1)

An aqueous solution of 30 g of inert bone gelatine and 40 g of KBr in 3 l of water was introduced into a 10 l reaction vessel. 1500 ml of a ⅔ molar silver nitrate solution and 1500 ml of a halide solution, ∪ molar iodide and 1 molar bromide, were added each at a constant rate to this initial amount at a temperature of 75° C. over a period of 30 minutes. After 10 minutes' pause, a further 1800 ml of a 0.5 molar aqueous $AgNO_3$ solution and 1800 ml of a 0.55 molar ammonium bromide solution were added at a constant rate over a period of 30 min at 75° C.

The emulsion was then cooled, flocculated by acidification and addition of a flocculating agent. The flocculate was washed repeatedly and redispersed with additional inert bone gelatine such that a silver/gelatine weight ratio of 1:0.3 (related to silver nitrate) was achieved.

The emulsion obtained in this manner had an average grain diameter of 0.9 μm and an iodide content of 9.9 mol. %.

On the basis of electron micrographs, the proportion of tabular crystals in the total projected area was approximately 25%. The average aspect ratio of the tabular crystals was 3.1. EM 1 is a comparison emulsion.

EM 2 (According to the Invention)

EM 2 was produced in the same manner as EM 1, with the difference that the initial amount additionally contained 0.34 g of copolymer 1. The proportion of tabular crystals in the total projected area was 55% and the average aspect ratio of the tabular crystals 6.

EM 3 (According to the Invention)

EM 3 was produced in the same manner as EM 1, with the difference that the initial amount additionally contained 1.36 g of copolymer 1. The proportion of tabular crystals in the total projected area was 78% and the average aspect ratio of the tabular crystals 10.

EM 4 (According to the Invention)

EM 4 was produced in the same manner as EM 1, with the difference that the initial amount additionally contained 3.4 g of copolymer 1. The proportion of tabular crystals in the total projected area was 85% and the average aspect ratio of the tabular crystals>15.

EM 5 (Comparison)

EM 5 was produced in the same manner as EM 1, with the difference that the initial amount additionally contained 0.17 g of the compound PVP K30. The proportion of tabular crystals in the total projected area was 65% and the average aspect ratio of the tabular crystals 7.

EM 6 (Comparison)

EM 6 was produced in the same manner-as EM 1, with the difference that the initial amount additionally contained 0.68 g of the compound PVP K30. The proportion of tabular crystals in the total projected area was 80% and the average aspect ratio of the tabular crystals 9.

EM 7 (Comparison)

EM 7 was produced in the same manner as EM 1, with the difference that the initial amount additionally contained 1.7 g of the compound PVP K30. The proportion of tabular crystals in the total projected area was 87% and the average aspect ratio of the tabular crystals 17.

PVP K30 is a polyvinylpyrrolidone with $M_w$~30000.

EM 8 (According to the Invention)

EM 8 was produced in the same manner as EM 1, with the difference that the initial amount additionally contained 0.34 g of copolymer 13. The proportion of tabular crystals in the total projected area was 45% and the average aspect ratio of the tabular crystals 5.

EM 9 (According to the Invention)

EM 9 was produced in the same manner as EM 1, with the difference that the initial amount additionally contained 1.36 g of copolymer 13. The proportion of tabular crystals in the total projected area was 72% and the average aspect ratio of the tabular crystals 11.

EM 10 (According to the Invention)

EM 10 was produced in the same manner as EM 1, with the difference that the initial amount additionally contained 3.4 g of copolymer 13. The proportion of tabular crystals in the total projected area was 78% and the average aspect ratio of the tabular crystals>12.

EM 11 (Comparison)

EM 11 was produced in the same manner as EM 1, with the difference that the initial amount additionally contained 0.34 g of comparison polymer VP 1. The proportion of tabular crystals in the total projected area was 55% and the average aspect ratio of the tabular crystals 6.5.

EM 12 (Comparison)

EM 12 was produced in the same manner as EM 1, with the difference that the initial amount additionally contained 1.36 g of comparison polymer VP 1. The proportion of tabular crystals in the total projected area was 73% and the average aspect ratio of the tabular crystals 8.

EM 13 (Comparison)

EM 13 was produced in the same manner as EM 1, with the difference that the initial amount additionally contained 3.4 g of comparison polymer VP 1. The proportion of tabular crystals in the total projected area was 82% and the average aspect ratio of the tabular crystals 15.

Comparison polymer VP 1 was produced by polymerising vinylpyrrolidone in a gelatine solution. The ratio by weight of PVA:gelatine is 1.0.

Emulsion 14 (EM 14)

An aqueous solution of 30 g of inert bone gelatine, 36 g of KBr and 3.2 g of KI in 3 l of water was introduced into a 10 l reaction vessel.

1200 ml of an aqueous solution of 130 g of $AgNO_3$ and 1200 ml of an aqueous solution of 150 g of KBr and 6.8 g of KI were added each at a constant rate to this initial amount at a temperature of 70° C. over a period of 30 minutes.

After 10 minutes' pause, a further 1600 ml of an aqueous solution of 204 g of $AgNO_3$ and 1600 ml of an aqueous solution of 130 g of $NH_4Br$ were added at a constant rate over a period of 32 min.

The emulsion was then cooled, flocculated by acidification and addition of a flocculating agent. The flocculate was washed repeatedly and redispersed with additional inert bone gelasine such that a silver/gelatine weight ratio of 1:0.3 (related to silver nitrate) was achieved.

The emulsion obtained in this manner had an average grain diameter of 0.8 μm and an iodide content of 3 mol. %.

On the basis of electron micrographs, the proportion of tabular crystals in the total projected area was approximately 35%. The average aspect ratio of the tabular crystals was 4. EM 14 is a comparison emulsion.

EM 15 (According to the Invention)

EM 15 was produced in the same manner as EM 14, with the difference that the initial amount additionally contained 0.34 g of copolymer 1. The proportion of tabular crystals in the total projected area was 68% and the average aspect ratio of the tabular crystals 7.5.

EM 16 (According to the Invention)

EM 16 was produced in the same manner as EM 14, with the difference that the initial amount additionally contained 1.36 g of copolymer 1. The proportion of tabular crystals in the total projected area was 84% and the average aspect ratio of the tabular crystals 14.

EM 17 (According to the Invention)

EM 17 was produced in the same manner as EM 14, with the difference that the initial amount additionally contained 3.4 g of copolymer 1. The proportion of tabular crystals in the total projected area was 92% and the average aspect ratio of the tabular crystals 18.

EM 18 (Comparison)

EM 18 was produced in the same manner as EM 14, with the difference that the initial amount additionally contained 0.17 g of compound PVP K30. The proportion of tabular crystals in the total projected area was 73% and the average aspect ratio of the tabular crystals 8.

EM 19 (Comparison)

EM 19 was produced in the same manner as EM 14, with the difference that the initial amount additionally contained 0.68 g of compound PVP K30. The proportion of tabular crystals in the total projected area was 87% and the average aspect ratio of the tabular crystals 16.

EM 20 (Comparison)

EM 20 was produced in the same manner as EM 14, with the difference that the initial amount additionally contained 1.7 g of compound PVP K30. The proportion of tabular crystals in the total projected area was 94% and the average aspect ratio of the tabular crystals 21.

EM 21 (According to the Invention)

EM 21 was produced in the same manner as EM 14, with the difference that the initial amount additionally contained 0.34 g of copolymer 3. The proportion of tabular crystals in the total projected area was 55% and the average aspect ratio of the tabular crystals 6.

EM 22 (According to the Invention)

EM 22 was produced in the same manner as EM 14, with the difference that the initial amount additionally contained 1.36 g of copolymer 3. The proportion of tabular crystals in the total projected area was 78% and the average aspect ratio of the tabular crystals 11.

EM 23 (According to the Invention)

EM 23 was produced in the same manner as EM 14, with the difference that the initial amount additionally contained 3.4 g of copolymer 3. The proportion of tabular crystals in the total projected area was 80% and the average aspect ratio of the tabular crystals 14.

Silver halide emulsions EM 1 to EM 23 were ripened with sulphur and gold compounds to the optimum sensitivity/fog ratio, stabilised with 5 mmol of 4-hydroxy-6-methyl-1,3,3a, 7-tetraazaindene per mol of $AgNO_3$ and spectrally sensitised with red sensitiser S1. The following layer structures 1 to 4, differing solely in the type of emulsion used, were then produced. The optimum quantity of sensitiser, fog, relative red sensitivity and relative blue sensitivity were determined; optimum quantity of sensitiser is the amount of sensitiser which yields the highest red sensitivity. The support was cellulose triacetate; quantities relate to 1 $m^2$.

| | |
|---|---|
| Layer 1 | (Anti-halo layer)<br>Black colloidal silver sol prepared from<br>0.4 g Ag and<br>3.0 g gelatine |
| Layer 2 | (Interlayer)<br>0.5 g gelatine |
| Layer 3 | (Red-sensitive layer)<br>Red-sensitised emulsion according to table 3 prepared from<br>5.1 g $AgNO_3$<br>6.0 g gelatine<br>2.4 g cyan coupler BG 1 |
| Layer 4 | (Interlayer)<br>1.0 g gelatine |
| Layer 5 | (Hardening layer)<br>0.24 g gelatine<br>0.3 g hardener of the formula |

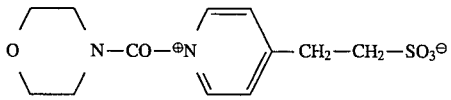

Red sensitiser S1:

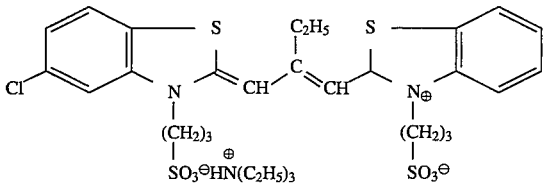

Cyan coupler BG 1:

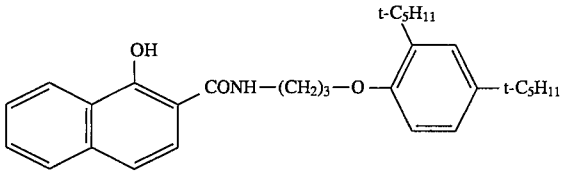

The samples were exposed in a sensitometer behind a step wedge, developed in the following developer at 38° C. for 195 seconds and subjected to the remaining processing stages.

Developer:

| | |
|---|---|
| 1-hydroxyethane-1,1-diphosphonic acid disodium salt | 2 g |
| Ethylene diamine-N,N,N',N'-tetraacetic acid | 2 g |
| Potassium carbonate | 34.1 g |
| Sodium hydrogen carbonate | 1.55 g |
| Sodium disulphite | 0.28 g |
| Sodium sulphite | 3.46 g |
| Potassium bromide | 1.34 g |
| Hydroxylamine sulphate | 2.4 g |
| 4-amino-3-methyl-N-ethyl-N-(β-hydroxyethyl)-aniline | 4.7 g |
| make up to 1 l with water. | |

The remaining processing stages comprise the following baths:

| | |
|---|---|
| Stop bath | 1 minute at 38° C. |
| Bleaching bath | 3 ¼ minutes at 38° C. |
| Rinsing | 3 ½ minutes at 38° C. |
| Fixing bath | 3 ¼ minutes at 38° C. |
| Rinsing | 5 minutes at 38° C. |

The stop bleaching and fixing baths are as customarily used (*British Journal of Photography*, 1974, pages 597 and 598).

The results are shown in table 3.

TABLE 3

| Emulsion | Optimum amount of red sensitiser S 1 μmol/mol $AgNO_3$ | Relative red sensitivity | Relative blue sensitivity | Fog | Proportion of tabular crystals in total projected area (%) | Aspect ratio |
|---|---|---|---|---|---|---|
| EM 1 | 240 | 100 | 100 | 26 | 25 | 3.5 |
| EM 2 | 260 | 115 | 105 | 26 | 55 | 6 |
| EM 3 | 280 | 125 | 98 | 27 | 78 | 10 |
| EM 4 | 240 | 105 | 98 | 25 | 85 | 14 |
| EM 5 | 210 | 95 | 100 | 23 | 65 | 7 |
| EM 6 | 190 | 80 | 95 | 19 | 80 | 9 |
| EM 7 | 120 | 75 | 85 | 15 | 87 | 17 |
| EM 8 | 240 | 105 | 100 | 25 | 45 | 5 |
| EM 9 | 250 | 120 | 105 | 25 | 72 | 11 |
| EM 10 | 220 | 98 | 95 | 24 | 78 | 12 |
| EM 11 | 200 | 98 | 100 | 22 | 55 | 6.5 |

TABLE 3-continued

| Emulsion | Optimum amount of red sensitiser S 1 μmol/mol $AgNO_3$ | Relative red sensitivity | Relative blue sensitivity | Fog | Proportion of tabular crystals in total projected area (%) | Aspect ratio |
|---|---|---|---|---|---|---|
| EM 12 | 180 | 90 | 100 | 20 | 73 | 8 |
| EM 13 | 130 | 70 | 90 | 18 | 82 | 15 |
| EM 14 | 280 | 100 | 100 | 23 | 35 | 4 |
| EM 15 | 300 | 120 | 105 | 24 | 68 | 7.5 |
| EM 16 | 330 | 130 | 100 | 25 | 84 | 14 |
| EM 17 | 280 | 105 | 100 | 21 | 92 | 18 |
| EM 18 | 210 | 98 | 95 | 20 | 73 | 8 |
| EM 19 | 180 | 85 | 98 | 18 | 87 | 16 |
| EM 20 | 150 | 70 | 90 | 16 | 94 | 21 |
| EM 21 | 290 | 100 | 98 | 20 | 55 | 6 |
| EM 22 | 300 | 105 | 98 | 19 | 78 | 11 |
| EM 23 | 260 | 100 | 100 | 17 | 80 | 14 |

It may be seen that there is a distinct increase in both the proportion of tabular crystals and the aspect ratio with all the additives used.

The sensitivity values for EM 2 to EM 13 are related to EM 1 (=100), those for EM 15 to EM 23 to EM 14 (=100).

Table 3 shows, however, that only the emulsions produced with the compounds according to the patent may be spectrally sensitised in a manner which is usable for photographic applications. The comparison compounds prevent effective spectral sensitisation.

EXAMPLE 2

American patent U.S. Pat. No. 4,714,671 describes plasticiser latices with and without a core/shell structure. These copolymers exhibit good plasticising properties, but are unstable when electrolytes or solvents such as acetone are added. The copolymers 15, 16, 20, 21 according to the invention are of a comparable monomer composition and additionally contain the peptide monomers according to the invention. As is shown in table 4, the copolymers according to the invention have substantially greater stability against the stated additions.

Stability is tested by adding 0.5 ml of the electrolyte solution or 100 ml of acetone dropwise while stirring to 100 ml of the latex in a 250 ml beaker.

Comparison polymers 15A, 16A, 20A and 21A were produced in the same manner as the copolymers 15, 16, 20 and 21 according to the invention, but without using the peptide monomers 2 and 3.

TABLE 4

| Copolymer | Addition of electrolyte (10 wt. % aqueous solution) | Addition of acetone | Stability[1)] |
|---|---|---|---|
| 15 | $CaCl_2$ | – | + |
| 15 | NaOH | – | + |
| 15 | — | + | + |
| 15 A | $CaCl_2$ | – | — |
| 15 A | NaOH | – | — |
| 15 A | — | + | — |
| 16 | $CaCl_2$ | – | + |
| 16 | NaOH | – | + |
| 16 | — | + | + |
| 16 A | $CaCl_2$ | – | — |
| 16 A | NaOH | – | — |
| 16 A | — | + | — |

TABLE 4-continued

| Copolymer | Addition of electrolyte (10 wt. % aqueous solution) | Addition of acetone | Stability[1)] |
|---|---|---|---|
| 20 | $CaCl_2$ | – | + |
| 20 | NaOH | – | + |
| 20 | — | + | + |
| 20 A | $CaCl_2$ | – | — |
| 20 A | NaOH | – | — |
| 20 A | — | + | — |
| 21 | $CaCl_2$ | – | + |
| 21 | NaOH | – | + |
| 21 | — | + | + |
| 21 A | $CaCl_2$ | – | — |
| 21 A | NaOH | – | — |
| 21 A | — | + | — |

[1)]— latex flocculates
– particle enlargement
+ latex reamins stable

We claim:

1. A photographic silver halide material with a support and at least one photosensitive silver halide layer, characterized in that the material contains at least one copolymer with polypeptide segments, wherein the polypeptide segment are derived from polypeptides with a weight average molecular weight Mw of 2,000 to 40,000, wherein the copolymer is obtained by reaction of a polypeptide with a reactive monomer and subsequent copolymerization of the resultant peptide monomer with at least one other comonomer, and wherein the reactive monomer is of the formula

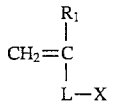

in which $R_1$ means H, alkyl or halogen

L means a chemical bond or a divalent bridging member and

X means —COCl, —NCO, —Cl or —Br.

2. Photographic silver halide material according to claim 1, wherein the comonomer is of the formula $$CH_2{=}\overset{\overset{R_1}{|}}{C}{-}L_1{+}L_2{+}_m{+}L_3{+}_n Q$$

in which $R_1$ is H, alkyl or halogen $L_1$ is a —CO—, —COO—, —CONH— or phenylene group, $L_2$ is an alkylene group with 1 to 20 C atoms or an arylene group with 6 to 20 C atoms, Q is a group non-reactive with $—NH_2$, —COOH or —OH or a photographically useful group, $L_3$ is —COO—, —OCO—, —CONH—, —NH—CO—O—, —NHCO—, $—SO_2NH—$, $—NHSO_2—$, $—SO_2—$group or —O—, m is 0 or 1 n is also 0 in the even that m is 0, otherwise 0 or 1.

3. Photographic silver halide material according to claim 1, wherein the copolymer with polypeptide segments is in a quantity of 0.5 mg to 5 $g/m^2$.

4. Photographic silver halide material according to claim 1, wherein the copolymer with polypeptide segments is in a quantity of 2.5 mg to 1 $g/m^2$.

5. Photographic silver halide material according to claim 1, wherein the polypeptide is obtained from collagen or gelatine by hydrolyric or enzymatic degradation.

6. Photographic silver halide material according to claim 1, wherein the reactive monomer is of the formula $$CH_2{=}\overset{\overset{R_1}{|}}{\underset{\underset{L_1{+}L_2{+}_m{+}L_3{+}_n X}{|}}{C}}$$

in which $R_1$ and X have the meaning stated in claim 1, $L_1$ is a —CO—, —COO—, —CONH— or phenylene group, $L_2$ is an alkylene group with 1 to 20 C atoms or an arylene group with 6 to 20 C atoms, $L_3$ is a —COO—, —OCO—, —CONH—, —NH—CO—O—, —NHCO—, $—SO_2NH—$, $—NHSO_2—$, $—SO_2—$ group or —O—, m is 0 or 1 n is also 0 in the event that m is 0, otherwise 0 or 1.

7. Photographic silver halide material according to claim 1, wherein the copolymer with polypeptide segments consists of 1 to 60 wt. % of residues derived from the peptide monomer and 40 to 99 wt. % of residues derived from comonomers.

8. The photographic silver halide material according to claim 1, wherein the peptides have a weight average molecular weight $M_w$ of 3,000 to 30,000.

9. The photographic silver halide material as claimed in claim 1, wherein the peptides are selected from the group consisting of amino acids glycine, alanine, serine, cysteine, phenylalanine, tyrosine, tryptophan, threonine, methionine, valine, proline, leucine, isoleucine, lysine, arginine, aspartic acid, asparagine hydroxyproline, glutamic acid and glutamine.

10. The photographic silver halide material as claimed in claim 9, wherein the peptides are selected from the group consisting of glycine, proline, hydroxyproline, glutamic acid, alanine, arginine, aspartic acid and lysine.

11. The photographic silver halide material according to claim 10, wherein the polypeptides are more than 5 weight percent soluble in water at a pH of 7° and 20° C. and, as a 20 weight percent aqueous solution have a viscosity of less than 20 mPa.s at 40° C.

12. The photographic silver halide material according to claim 1, wherein $R_1$ is an alkyl containing 1 to 4 carbon atoms or Cl.

* * * * *